US009659740B2

(12) United States Patent
Simon et al.

(10) Patent No.: US 9,659,740 B2
(45) Date of Patent: May 23, 2017

(54) RADIATION GENERATOR ADJUSTING BEAM FOCUSING BASED UPON A DIAGNOSTIC ELECTRODE

(71) Applicant: Schlumberger Technology Corporation, Sugar Land, TX (US)

(72) Inventors: Matthieu Simon, Houston, TX (US); Kenneth E. Stephenson, New Castle, VA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 145 days.

(21) Appl. No.: 14/574,309

(22) Filed: Dec. 17, 2014

(65) Prior Publication Data

US 2015/0179390 A1 Jun. 25, 2015

Related U.S. Application Data

(60) Provisional application No. 61/919,915, filed on Dec. 23, 2013.

(51) Int. Cl.

| | |
|---|---|
| ***H01J 35/14*** | (2006.01) |
| ***H05G 1/26*** | (2006.01) |
| ***H05G 1/30*** | (2006.01) |
| ***H05H 3/06*** | (2006.01) |

(52) U.S. Cl.

CPC ..... *H01J 35/14* (2013.01); *H05G 1/265* (2013.01); *H05G 1/30* (2013.01); *H05H 3/06* (2013.01)

(58) Field of Classification Search

CPC .. H01J 35/00; H01J 35/02; H01J 35/04; H01J 35/045; H01J 35/06; H01J 35/065; H01J 35/08; H01J 35/14; H01J 35/16; H01J 2235/00; H01J 2235/02; H01J 2235/06; H01J 2235/062; H01J 2235/08; H01J 2235/081

USPC ..... 378/119, 121, 122, 138

See application file for complete search history.

(56) References Cited

U.S. PATENT DOCUMENTS 7,639,781 B2 12/2009 Shampine et al.

OTHER PUBLICATIONS

Niedrig et al., "Electron backscattering from thin films", Journal of Applied Physics, vol. 53, 1982, pp. R15-R49.

*Primary Examiner* — Jurie Yun
(74) *Attorney, Agent, or Firm* — Michael Dae

(57) ABSTRACT

A radiation generator is provided that includes a target, a cathode to emit electrons in a downstream direction toward the target, a first conductive member downstream of the cathode, and a second conductive member downstream of the cathode. The first and second conductive members have a potential difference with the cathode such that a resultant electric field accelerates the electrons toward the target. A diagnostic current in the second conductive member and a target current in the target may be measured, and an electrical property of the first conductive member may be adjusted based upon the diagnostic current and the target current.

19 Claims, 3 Drawing Sheets

RADIATION GENERATOR ADJUSTING BEAM FOCUSING BASED UPON A DIAGNOSTIC ELECTRODE

CROSS-REFERENCE TO RELATED APPLICATIONS

This application claims benefit of U.S. Provisional Patent Application Ser. No. 61/919,915, filed Dec. 23, 2013, which is herein incorporated by reference.

BACKGROUND

Compact radiation generators, such as pulsed neutron generators and x-ray generators, are useful for well logging applications. A typical radiation generator includes a charged particle source, an acceleration column, and a target. In operation, such a radiation generator generates charged particles with the charged particle source, focuses the charged particles into a beam, then accelerates the beam toward and into the target using the acceleration column. When the charged particles of the beam strike the target, radiation, such as neutron or x-ray radiation, is generated. This radiation is emitted or directed into an oil formation from within a borehole, and interacts with constituents of the oil formation, which ultimately generates formation sourced radiation. A well logging tool equipped with suitable radiation detectors can detect the formation sourced radiation, and determine properties of the formation based thereupon.

There are many operating parameters and conditions of such compact radiation generators that can affect performance, consistency of radiation output, and the service life of the compact radiation generator. One such operating parameter is whether the beam is properly focused. If the beam is not properly focused, various reactions can occur which can negatively impact the operation of the compact radiation generator. Therefore, new ways of maintaining proper beam focus are desired.

SUMMARY

The present disclosure relates to a radiation generator that includes a target, a cathode to emit electrons in a downstream direction toward the target, a first conductive member downstream of the cathode, and a second conductive member downstream of the cathode, where the first and second conductive members are configured such that a resultant electric field accelerates the electrons toward the target. The radiation generator also includes processing circuitry configured to measure a diagnostic current in the second conductive member, measure a target current in the target, and adjust an electrical property of the first conductive member based upon the diagnostic current and the target current.

DETAILED DESCRIPTION

The present description is made with reference to the accompanying drawings, in which example embodiments are shown. However, many different embodiments may be used, and thus the description should not be construed as limited to the embodiments set forth herein. Rather, these embodiments are provided so that this disclosure will be thorough and complete. Like numbers refer to like elements throughout.

Figure 1:
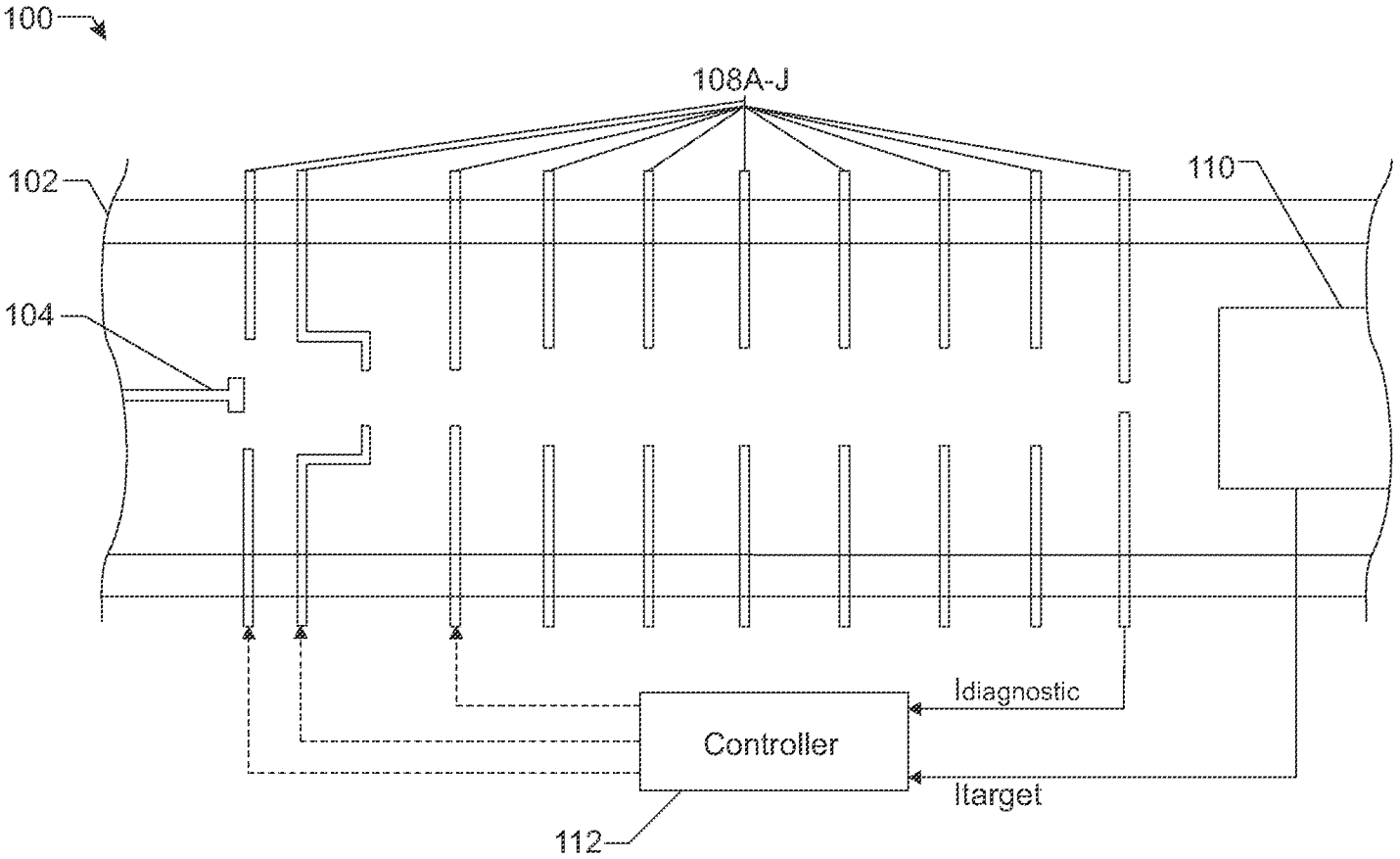
FIG. 1 shows a schematic cross sectional view of a radiation generator having a diagnostic electrode, in accordance with the present disclosure.

Referring initially to FIG. 1, a x-ray generator 100 is now described. The x-ray generator 100 includes a sealed envelope 102, creating a substantially vacuum environment for operation. At one end of the x-ray generator 100 is an active cathode 104 (such as a thermionic cathode, spindt cathode, field emitter array cathode, array of nanotubes, or array of carbon nanotubes) and at the other end of the x-ray generator is a target 110. For reference, the direction pointing toward the target 110 shall be referred to hereinafter as "downstream", and the direction pointing toward the active cathode 104 shall be referred to hereinafter as "upstream."

Extending in a downstream direction from adjacent the cathode 104 to adjacent the target 110 is a series of electrodes 108A-108J. The electrode 108A is most adjacent the cathode 104, and is a Whelen focus, or focusing electrode. Moving downstream from the focusing electrode 108A is the puller electrode 108B. In operation, the cathode 104 emits electrons, and the puller electrode 108B has a potential difference with the cathode 104 such that the resulting electric field helps to pull the electrons out of the cathode and into free space, and to accelerate them through the aperture in the puller electrode 108B and into the acceleration column, which is comprised of the electrodes 108C-108J. The potential at the focusing electrode 108A helps to focus these electrons into a tight beam, although as will be explained in detail later, other electrodes or other structures can also help to focus the beam.

If the electron beam is not properly focused, the electrons can strike the various electrodes 108C-108J, or structures supporting the target 110 (not shown) which can result in the creation of x-rays via bremstrahlug or other mechanisms. These x-rays would be generated at an undesired energy, and at an undesired location in the x-ray generator 100, and can strike any high voltage insulation (not shown) on the inside surface of the vacuum envelope 102, degrading the insulation, which can ultimately alter the electric field inside the x-ray generator and therefore affect the operation and performance of the x-ray generator.

Consequently, it is desirable for the electron beam to be properly focused. However, conditions inside the x-ray generator 100 and manufacturing variances of the various parts thereof can lead to situations where the beam is not properly focused, even though by design it is intended to be. Therefore, it is desirable to have a way to detect whether the beam is properly focused, and to then adjust the focusing of the beam in response to the measurement of beam focus.

To that end, at least one of the electrodes 108C-108J can be designated as a so called diagnostics electrode. The aperture in that electrode can be made to be smaller than the aperture in the other electrodes, such that the electron beam hits the diagnostic electrode. The current resulting from the electron beam hitting the diagnostic electrode, referred to as the diagnostic current, can then be compared to the current resulting from the electron beam hitting the target 110, referred to as the target current, to determine the beam focusing quality. This function is performed by the controller 112 which monitors both the diagnostic current and the beam current. If the controller 112 determines that tuning of the beam focus would be desirable, it can then make changes to the beam focusing, as will be explained below.

To avoid the creation of undesirable x-rays when the electron beam strikes the diagnostic electrode, the diagnostic electrode can be constructed from a low-Z material (material having a low atomic number), since the number of x-rays created is proportional to the atomic number of the material struck. A suitable low-Z material for construction of the diagnostic electrode is beryllium due to its atomic number of 4, but carbon, titanium, and aluminum could also be used. In addition, instead of constructing the diagnostic electrode entirely from the low-Z material, the diagnostic electrode could be constructed from a higher-Z substrate, with a low-Z coating thereon.

It is apparent that issues caused by an unfocused beam could be mitigated by constructing each electrode 108A-J from such a low-Z material, but that would add cost and complexity to an already expensive and difficult to produce device. Typical electrodes 108A-J are instead produced from kovar.

Since it is typically easier to affect beam focusing closer to the beam source, the controller 112 may alter the potentials at the focusing electrode 108A, the puller electrode 108B, and/or the next electrode in line 108C to help obtain desirable beam focusing characteristics. It should be understood that in some applications, however, the controller 112 may independently alter the potentials of each electrode 108A-J so as to obtain desirable beam focusing.

Figure 2:
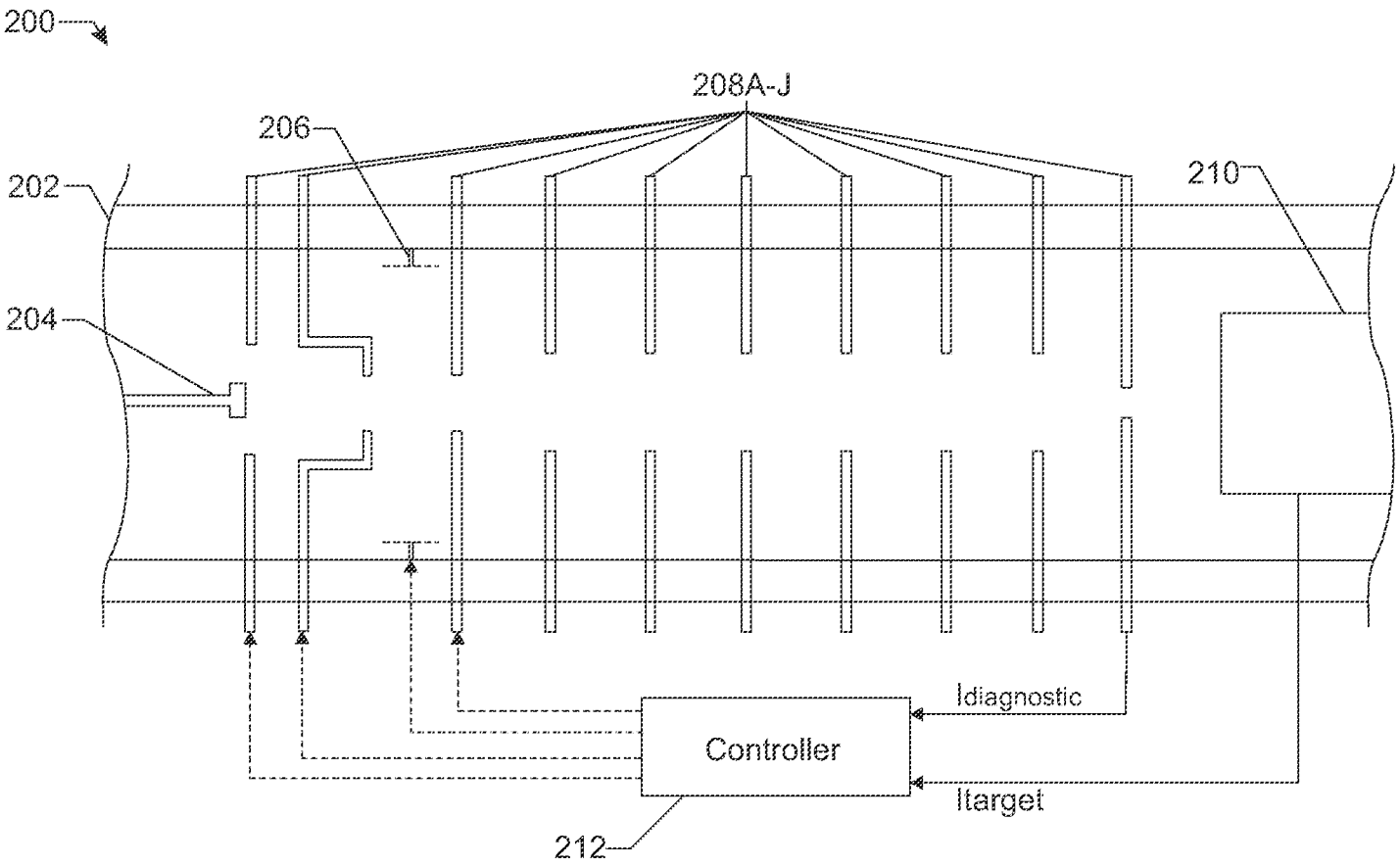
FIG. 2 shows a schematic cross sectional view of a radiation generator having a diagnostic electrode and a grid to adjust beam focusing, in accordance with the present disclosure.

As shown in FIG. 2, there may be a pair of conductive grids 206 downstream of the puller electrode 208B, and the controller 212 may independently alter the potentials of each grid 206 so as to obtain desirable beam focusing. This may also be in conjunction with, or instead of, independently altering the potentials of one of more of the electrodes 208A-208C.

Figure 3:
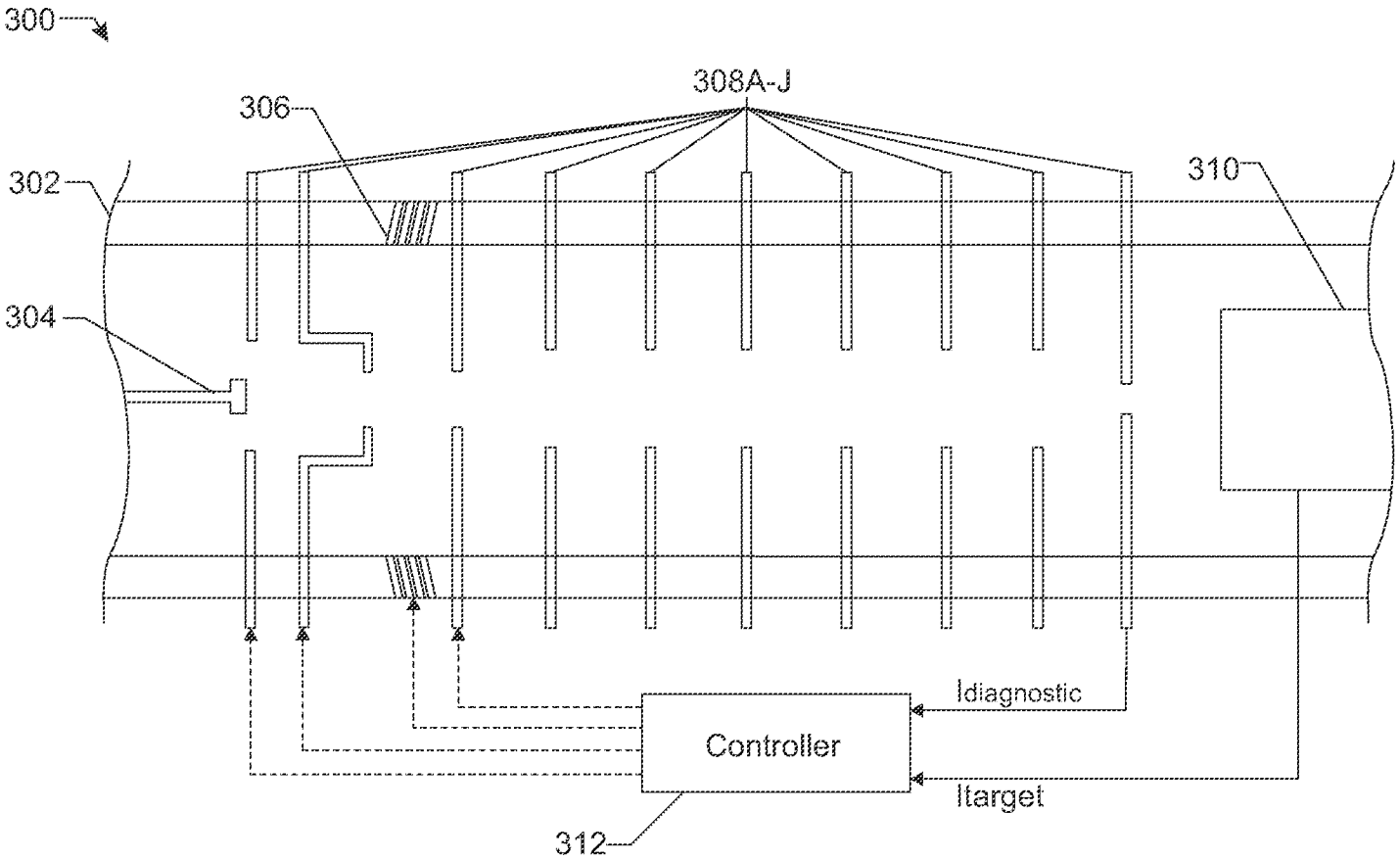
FIG. 3 shows a schematic cross sectional view of a radiation generator having a diagnostic electrode and a coil to adjust beam focusing, in accordance with the present disclosure.

In another application shown in FIG. 3, there may be a pair of conductive coils 306 downstream of the puller electrode 308B, and the controller 212 may independently alter the current flowing through the conductive coils so as to obtain desirable beam focusing. This may also be in conjunction with, or instead of, independently altering the potentials of one of more of the electrodes 308A-308C.

The controller 112 may include processing circuitry that may execute machine-readable instructions used to implement one or more operations described herein and, in some embodiments, to implement a portion of the example radiation generator described herein. Such processing circuitry may provide the processing capability to execute programs, user interfaces, and other functions of an example radiator generator. For example, the processing circuitry of the controller 112 may perform operations that include, as described above, measuring a diagnostic current in the second conductive member of the radiation generator, measuring a target current in the target, and adjusting an electrical property of the first conductive member based upon the diagnostic current and the target current. The processing circuitry may be or may include one or more processors and may include multipurpose microprocessors, special purpose microprocessors such as application-specific integrated circuits (ASICs), digital signal processors (DSPs), reduced instruction set processors (RISCs), and other suitable processors or combination thereof. The processing circuitry of the controller 112 may also include single-core processors and multicore processors. In some embodiments, multiple processors may be employed to provide for parallel or sequential execution of the operations described herein. Operations described herein may be performed by such processing circuitry via execution of one or more computer programs that perform functions by operating on input data and generating corresponding output.

The controller 112 may also include a memory (which may include one or more tangible non-transitory computer readable storage mediums) accessible by the processing circuitry of the controller 112. For example, the memory may include volatile memory, such as random access memory (RAM), and non-volatile memory, such as ROM, flash memory, a hard drive, other suitable optical, magnetic, or solid-state storage mediums or combination thereof. The memory of the controller 112 may store executable computer code, such as the firmware for the controller 112 and other executable code for providing functions of the controller 112. Such executable computer code may include program instructions executable by the processing circuitry of the controller 112 to implement one or more embodiments of the present disclosure. Such program instructions may include or define a computer program (which in certain forms is known as a program, software, software application, script, or code).

Although the above drawings and descriptions have been given relative to an x-ray generator, it should be appreciated that the beam focusing techniques described herein are equally applicable to neutron generators (pulsed or continuous wave), and that such implementation would be similar, needing no further description herein.

While the above has been described with respect to a limited number of embodiments, those skilled in the art, having benefit of this disclosure, will appreciate that other embodiments can be devised which do not depart from the scope of this disclosure.

The invention claimed is:

1. A radiation generator comprising:

a target;

a cathode to emit electrons in a downstream direction toward the target;

a first conductive member downstream of the cathode;

a second conductive member downstream of the cathode;

the first and second conductive members being configured such that a resultant electric field accelerates the electrons toward the target; and processing circuitry configured to perform operations comprising:

measuring a diagnostic current in the second conductive member, measuring a target current in the target, and adjusting an electrical property of the first conductive member based upon the diagnostic current and the target current.

2. The radiation generator of claim 1, wherein the first conductive member has a first opening therein through which the electrons travel as they are accelerated toward the target; wherein the second conductive member has a second opening therein through which the electrons travel as they are accelerated toward the target; and wherein the second opening is smaller than the first opening.

3. The radiation generator of claim 1, wherein the first conductive member is constructed from a first material; wherein the second conductive member is constructed from a second material; and wherein an average atomic number of constituents of the second material is lower than an average atomic number of constituents of the first material.

4. The radiation generator of claim 1, wherein the first conductive member is constructed from kovar; and wherein the second conductive member is constructed from beryllium.

5. The radiation generator of claim 1, wherein the first conductive member is constructed from at least one of beryllium, carbon, titanium, and aluminum.

6. The radiation generator of claim 1, wherein the second conductive member is constructed from at least one of beryllium, carbon, titanium, and aluminum.

7. The radiation generator of claim 1, wherein the first conductive member comprises a substrate with a coating thereon; and wherein the coating comprises at least one of beryllium, carbon, titanium, and aluminum.

8. The radiation generator of claim 1, wherein the second conductive member comprises a substrate with a coating thereon; and wherein the coating comprises at least one of beryllium, carbon, titanium, and aluminum.

9. The radiation generator of claim 1, wherein the first conductive member comprises a puller electrode downstream of and adjacent to the cathode; and wherein the second conductive member comprises a suppressor electrode upstream of and adjacent to the target.

10. The radiation generator of claim 1, wherein the first conductive member comprises a focusing electrode adjacent to the cathode; and wherein the second conductive member comprises a suppressor electrode upstream of and adjacent to the target.

11. The radiation generator of claim 1, further comprising a puller electrode downstream of and adjacent to the cathode; and wherein the first conductive member comprises a grid downstream of the puller electrode.

12. The radiation generator of claim 1, wherein the second conductive member has a greater volume than the first conductive member.

13. The radiation generator of claim 1, wherein the electrical property comprises a potential of the first conductive member.

14. The radiation generator of claim 1, wherein the first conductive member comprises a coil; and wherein the electrical property comprises a current flowing through the first conductive member.

15. The radiation generator of claim 1, wherein the cathode comprises a thermionic cathode.

16. The radiation generator of claim 1, wherein the cathode comprises an array of nanotubes.

17. The radiation generator of claim 1, wherein the cathode comprises an array of carbon nanotubes.

18. The radiation generator of claim 1, wherein the cathode comprises a spindt cathode.

19. The radiation generator of claim 1, wherein the cathode comprises a field emitter array cathode.

* * * * *